US006005946A

United States Patent [19]

Varga et al.

[11] Patent Number: 6,005,946

[45] Date of Patent: Dec. 21, 1999

[54] METHOD AND APPARATUS FOR GENERATING A MULTI-CHANNEL SIGNAL FROM A MONO SIGNAL

[75] Inventors: Imre Varga, Hannover; Jürgen Schmidt, Wunstorf, both of Germany

[73] Assignee: Deutsche Thomson-Brandt GmbH, Germany

[21] Appl. No.: 08/909,773

[22] Filed: Aug. 11, 1997

[30] Foreign Application Priority Data

Aug. 14, 1996 [DE] Germany ..... 196 32 734

[51] Int. Cl.[6] ..... H04R 5/00

[52] U.S. Cl. ..... 381/17

[58] Field of Search ..... 381/17, 18, 1, 381/61, 63; 84/DIG. 1, DIG. 26

[56] References Cited

U.S. PATENT DOCUMENTS 4,555,795 11/1985 Bedini ..... 381/17
5,235,646 8/1993 Wilde et al. ..... 381/17
5,301,236 4/1994 Iizuka et al. .
5,369,224 11/1994 Miyata ..... 84/DIG. 1

OTHER PUBLICATIONS

Journal of the Audio Engineering Society, "An Artificial Stereophonic Effect Obtained from a Single Audio Signal", Apr. 1958, vol. 6, No. 2.

*Primary Examiner*—Ping Lee
*Attorney, Agent, or Firm*—Joseph S. Tripoli; Peter M. Emanuel; Kuniyuki Akiyama

[57] ABSTRACT

The reproduction of mono audio signals leads to an unpleasant sound impression because of the lack of any spatial character. It is therefore desirable to produce a two-channel signal electrically from the single-channel input signal. Some of the known single-band methods are very costly and provide only an inadequate impression of a spatial character. In the case of the invention, a plurality of signals of different types are first of all formed from the mono input signal by filtering, and virtual single-band stereo signals are then generated separately for each of these signals of different types. These stereo signals are subsequently combined to form two output signals.

5 Claims, 1 Drawing Sheet

METHOD AND APPARATUS FOR GENERATING A MULTI-CHANNEL SIGNAL FROM A MONO SIGNAL

The invention relates to a method and an apparatus for generating a multi-channel signal from a mono signal.

1. Prior Art

The reproduction of mono audio signals leads to an unpleasant sound impression because of the lack of any spatial impression. It is therefore desirable to produce a two-channel signal (virtual, artificial, pseudo- or quasistereo) electrically from the single-channel (mono) input signal. The known methods may be called single-band methods. A summary of the known methods is provided in J. Blauert "Räumliches Hören" [Spatial listening], Hirtzel Verlag, Stuttgart, 1974:

LP/HP filtering (DE-A973570): the mono input signal is split by a low-pass filter and a high-pass filter. The correspondingly filtered signals form the left and right output signals of the pseudo-stereo system. This spectral separation produced by filtering results, however, in an unsatisfactory spatial representation;

from M. R. Schröder "An artificial stereophonic effect obtained from a single audio signal", Japanese Audio Engineering society, Volume 6, pages 74–79, 1958, it is known for reverberation to be used. The mono signal is made to reverberate in an echo chamber. Two microphones are used in order to record partially correlated signals, which then form the output signals, from this echo chamber. The disadvantage is that a reverberation chamber is required. Another exemplary embodiment of this version is to use electronic reverberation in order to produce two uncorrelated output signals. As in the first example, this device is highly complex;

from H. Laurisden, F. Schlegel, "Stereophonie und richtungsdiffuse Klangwiedergabe" [Stereophony and diffuse-direction sound reproduction], Gravesaner Bl ätter, Volume 5, pages 28–50, 1956 (the original by Lauridsen is published in the Norwegian language), and from M. R. Schroder "Improved quasi-stereophony and 'colorless' artificial reverberation", Japanese Acoustic Society Am., Volume 33, pages 1061–1064, 1961 and from G. R. Schodder, "Vortäuschen eines akustischen Raumeindrucks" [Simulating a spatial acoustic impression], Acustica, Volume 6, pages 482–488, 1956, a method is known in which complementary comb filters or all-pass filters are used to generate signal parts of different types. The mono signal is filtered twice, either in a pair of comb filters or in a pair of all-pass filters. These two pseudo-stereo output signals are produced by filters which have complementary amplitude characteristics, that is to say the sum of transfer functions is "1". In comb filtering, the input signal is delayed and attenuated. This signal is added to and subtracted from the original input signal in order to produce the left and right virtual stereo output signals. If the comb filters are implemented by a time-discrete circuit, they have the transfer functions $$H_1(z)=1+a*z^{(-N)} \text{ and } H_2(z)=1+a*z^{(-N)},$$

N being the delay expressed as the number of samples and "a" being the attenuating multiplication factor. This method produces a frequency split for the two output channels. Since some input signal frequencies appear only on the left side, while others appear only on the right side, this gives an impression of spatiality.

SUMMARY OF THE INVENTION

The disadvantage of the Lauridsen method is that the two output signals are not split in all frequency bands. Owing to the linear separations in the comb filters, some frequency bands are well separated, while others remain virtually in the centre of the stereo sound pattern. Normally, low and medium frequency bands are processed well, but this method does not produce any improvement for the high frequency bands.

The invention is based on the object of specifying an improved method for generating pseudo-stereo signals from a mono signal.

The invention is based on the further object of specifying an apparatus for application of the method according to the invention.

A multiple-band method is used in the invention. The invention improves the quality of reproduction by producing two partially coherent signals. Analogue or digital signal processing may be used in this case. The two partially coherent signals give the impression of spatiality.

In the case of the invention, a plurality of (at least two) signals of different types are first of all formed from the mono input signal by filtering, and virtual single-band stereo signals are then generated separately for each of these signals of different types. These stereo signals are subsequently combined to form two output signals. The virtual stereo systems preferably have different parameters in each signal path, in order to achieve a maximum spatial impression.

The invention overcomes the disadvantages of known pseudo-stereo systems. The signal quality is considerably better than the conventional LP/HP filter methods for single-band pseudo-stereo systems.

The relatively efficient method according to Lauridsen mentioned above, which uses comb filters or all-pass filters, produces only an inadequate spatial impression, because the linear splitting of the frequency characteristic of the comb filter is not matched to the logarithmic frequency sensitivity of the human hearing system (above about 500 Hz).

In contrast, the invention makes it possible to use pseudo-stereo splitting filters of different types in each frequency band. This results in excellent spatial resolution, considered with respect to frequency.

In principle, the method according to the invention is for a multi-channel signal to be generated from a mono signal by assigning elements of the mono signal to the channels of the multi-channel signal by means of filtering and/or frequency weighting of the spectrum of the mono signal and/or by means of echo production from the mono signal, such that these channels contain first signals of different types:

the spectrum of the mono signal being split, before this filtering, frequency weighting and/or echo production, into at least two second signals of different types, for example into different frequency bands;

the filtering, frequency weighting and/or echo production being carried out separately for each of these second signals of different types;

the output signals which are formed in this way for each of these second signals of different types being used to form the first output signals of different types.

In principle, the apparatus according to the invention is used for generating a multi-channel signal from a mono signal, elements of the mono signal being assigned to the channels of the multi-channel signal such that these channels contain first signals of different types. The apparatus contains:

first means, which use the spectrum of the mono signal to generate at least two second signals of different types, for example different frequency bands;

second means, which use filtering, frequency weighting and/or echo production to produce at least two output signals for each of these second signals of different types;

third means, which use the output signals formed in this way for each of these second signals of different types to form the first output signals of different types of the multi-channel signal.

BRIEF DESCRIPTION OF DRAWINGS

Exemplary embodiments of the invention are described with reference to the drawings, in which.

DETAILED DESCRIPTION OF THE EXEMPLARY EMBODIMENTS

Figure 1:
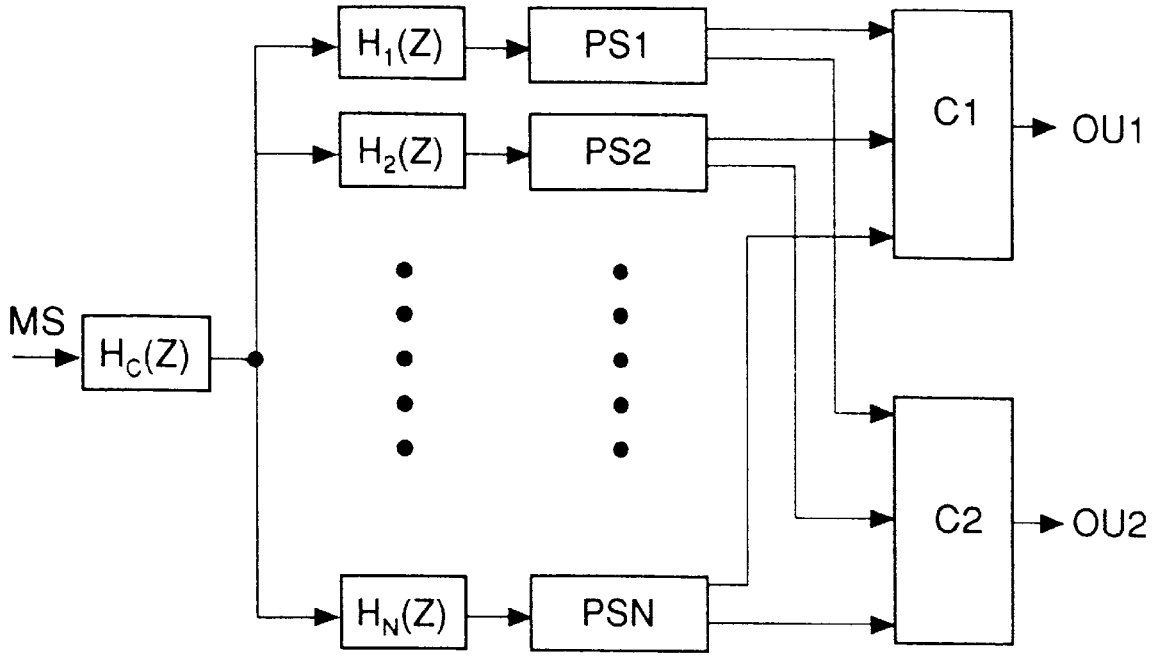
FIG. 1 shows a general block diagram for generating pseudo-stereo signals according to the invention.

FIG. 1 shows a four-stage system. Such a system can be produced by means of analogue or discrete-time techniques. The first stage consists of a compensation filter $H_c(z)$ for the mono signal MS, which compensates for the signal filtering effect (for example, frequency response errors and/or phase response errors) of the filters in the following stage. Without the compensation filter $H_c(z)$ the sum $H_i(z)$, i=1, . . . , N, is not equal to "1". An imaginary mono output signal which, by definition, is half the sum of the left and right output signals, would not be identical to the input signal of the overall circuit. This first stage is optional.

The following, second stage consists of N mutually matched filters, $H_1(z), H_2(z), \ldots, H_N(z)$, N being an integer greater than unity and the inputs of these filters being supplied with the output signal from the compensation filter $H_c(z)$. Very good results can be achieved even with N=2. These filters generate a plurality of channels of different types and may either have a characteristic such that they split the input signal into a plurality of frequency bands, or they may produce a weighting with respect to the frequency, that is to say attenuate some frequency ranges relative to others. In the first case, the filters are designed such that they separate the frequency bands as effectively as possible while, in the second case, each filter is designed such that only certain frequency bands are amplified, although no frequency band is filtered out virtually completely.

For example, the two following options may be used for designing the filters $H_i(z)$, i=1, . . . , N:

A) $H_1(z)$ high-pass filters, $H_2(z)$ . . . $H_{(n-1)}(z)$ bandpass filters, $H_N(z)$ low-pass filters or any other such sequence. The filter characteristics are chosen such that they split the frequency spectrum into frequency bands which are matched to specific—for example the logarithmic—hearing frequency sensitivities.

The blocks $H_i(z)$ represent frequency weighting filters of different types, that is to say they do not split the overall spectrum into different frequency ranges as in A), but have a different amplitude response, that is to say some amplitudes being attenuated, but still being audible.

The third stage consists of a number of single-band systems PS1, PS2, . . . , PSN, each of which is downstream of the tuned filters $H_1(z), H_2(z), \ldots, H_N(z)$ and which are used separately in each frequency band to produce artificial stereo signals or multi-channel signals with more than two channels. Any of the known single-band methods can be used for this purpose, the method mentioned above according to Lauridsen being advantageous. The parameters for generating the pseudo-stereo or multi-channel signals in each of the frequency bands are advantageously chosen to be different, which results in a considerable improvement being achieved in comparison with single-band methods where N=1.

The pseudo-stereo or multi-channel output signals from the blocks in the third stage are produced in the fourth stage by combination stages C1 and C2 which are downstream of the single-band systems PS1, PS2, . . . , PSN and which form the left output signal OU1 and the right output signal OU2, or else other output signals by means of further such combination stages. This combination may be carried out additively and/or subtractively, possibly with additional weighting.

Figure 2:
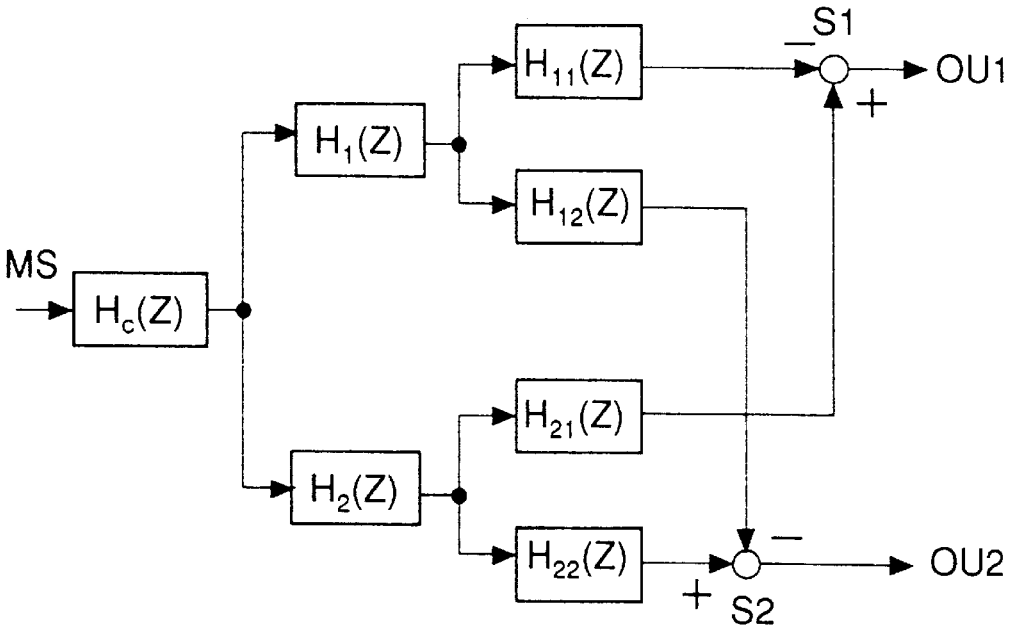
FIG. 2 shows a block diagram for an exemplary embodiment where N=2.

One exemplary embodiment of the invention relates to specific filter structures and parameters of the arrangement. To this end, it is intended to consider, with reference to FIG. 2, a discrete-time system where N=2 and, in the third stage, the method according to Lauridsen:

$H_{11}(z)=1+k1*z^{(-N1)}$;

$H_{12}(z)=1-k1*z^{(-N1)}$;

$H_{21}(z)=1+k2*z^{(-N2)}$;

$H_{22}(z)=1-k2*z^{(-N2)}$;

The values "k1" and "k2" are attenuating multiplication factors and, for example at a sampling frequency of $f_s$=48 kHz, have values of k1=0.65 . . . 0.85;

k2=0.75 . . . 0.95;

N1=600 . . . 1500;

N2=200 . . . 1000.

The frequency weighting filters in this example are given by:

$$H_1(z)=(1-q)/(1-q*z^{(-1)}),\ H_2(z)=1-q*z^{(-1)}.$$

The compensation filter then becomes:

$$H_c(z)=1/[H_2(z)-H_1(z)]=(1-q*z^{(-1)})/[q*c1*(1-((1+q)/c1)*z^{(-1)}+(c2/c1)*z^{(-2)}, \text{ where } c1=1+\sqrt{(1+q)},\ c2=\sqrt{(1-q)}.$$

The value "q" is an attenuating multiplication factor and has, for example, a value of q=0.6 . . . 0.75.

The first output signal OU1 is produced in a first subtracter S1 by subtracting the output signal of $H_{11}(z)$ from the output signal of $H_{21}(z)$. The second output signal OU2 is produced in a second subtracter S2 by subtracting the output signal of $H_{12}(z)$ from the output signal of $H_{22}(z)$.

The values for k1, k2, N1, N2 and q are advantageously matched depending on the programme material, that is to say they are chosen differently for music and speech. k1 and k2, or else other values, are advantageously chosen to be lower for speech than for music.

The invention provides good quality, particularly for pseudo-stereo and can, for example, be used in stereo television sets, in stereo radio receivers or in PCs in order to generate a pseudo-stereo signal from a received or existing mono signal.

Instead of pseudo-stereo or two-channel signals, multi-channel signals can also be generated by using an appropriate additional number of combiners C1, C2, S1, S2 with additional types of combination.

We claim:

1. A method for generating a pseudo-stereo signal from a mono signal, comprising the steps of:

generating from the mono signal a first signal using a first frequency weighting filter $H_1(z)=(1-q)/(1-q*z^{-1})$ and a second signal using a second frequency weighting filter $H_2(z)=1-q*z^{-1}$, wherein q has a value in the range 0.6 to 0.75;

passing said first signal in parallel through a first filter $H_{11}(z)=1+k1*z^{-N1}$ and a second filter $H_{12}(z)=1-k1*z^{-N1}$ and passing said second signal in parallel through a third filter $H_{21}(z)=1+k2*z^{-N2}$ and a fourth filter $H_{22}(z)=1-k2*z^{-N2}$, wherein k1 has a value in the range 0.65 to 0.85, k2 has a value in the range 0.75 to 0.95, N1 has a value in the range 600 to 1500 and N2 has a value in the range 200 to 1000;

subtracting the output signal of said first filter from the output signal of said third filter to form one channel of said pseudo-stereo signal; and subtracting the output signal of said second filter from the output signal of said fourth filter to form the other channel of said pseudo-stereo signal.

2. The method according to claim 1, further comprising the steps of:

compensation filtering said mono signal before said first and second frequency weighting filters.

3. The method according to claim 1, wherein said values for k1, k2, N1, N2 and q are chosen differently for music input signals and for speech input signals.

4. The method according to claim 3, wherein said values for K1 and K2 are lower for speech input signals than for music input signals.

5. Apparatus for generating a pseudo-stereo signal from a mono signal, comprising:

a first frequency weighting filter $H_1(z)=(1-q)/(1-q*z^{-1})$ for generating from the mono signal a first signal, a second frequency weighting filter $H_2(z)=1-q*z^{-1}$ for generating from the mono signal a second signal, wherein q has a value in the range 0.6 to 0.75;

a first filter $H_{11}(z)=1+k1*z^{-N1}$ and a second filter $H_{12}(z)=1-k1*z^{-N1}$ for filtering said first signal, a third filter $H_{21}(z)=1+k2*z^{-N2}$ and a fourth filter $H_{22}(z)=1-k2*z^{-N2}$ for filtering said second signal, wherein k1 has a value in the range 0.65 to 0.85, k2 has a value in the range 0.75 to 0.95, N1 has a value in the range 600 to 1500 and N2 has a value in the range 200 to 1000;

means for subtracting the output signal of said first filter from the output signal of said third filter for providing one channel of said pseudo-stereo signal; and means for subtracting the output signal of said second filter from the output signal of said fourth filter for providing the other channel of said pseudo-stereo signal.

* * * * *